US008791869B2

(12) United States Patent
Klos et al.

(10) Patent No.: US 8,791,869 B2
(45) Date of Patent: Jul. 29, 2014

(54) PORTABLE DUAL-BAND ANTENNA

(75) Inventors: Berthold Klos, Ottobrunn (DE); Dietmar Leugner, Munich (DE); Ludwig Nielsen, Starnberg (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 336 days.

(21) Appl. No.: 13/127,038

(22) PCT Filed: Jun. 24, 2009

(86) PCT No.: PCT/EP2009/004555

§ 371 (c)(1), (2), (4) Date: Apr. 29, 2011

(87) PCT Pub. No.: WO2010/049017

PCT Pub. Date: May 6, 2010

(65) Prior Publication Data

US 2011/0199271 A1 Aug. 18, 2011

(30) Foreign Application Priority Data

Oct. 30, 2008 (DE) ..... 10 2008 053 833
Jan. 8, 2009 (DE) ..... 10 2009 004 024

(51) Int. Cl.
*H01Q 21/00* (2006.01)

(52) U.S. Cl.
USPC ..... 343/725

(58) Field of Classification Search
USPC ..... 343/725, 702, 791, 900, 905
See application file for complete search history.

(56) References Cited

U.S. PATENT DOCUMENTS

| | | | | |
|---|---|---|---|---|
| 2,898,590 | A | 8/1959 | Pichitino | |
| 3,163,863 | A | 12/1964 | Fujino | |
| 3,624,657 | A | 11/1971 | Kahn | |
| 4,152,705 | A | 5/1979 | Kowols | |
| 5,252,984 | A | 10/1993 | Dorrie | |
| 5,532,703 | A * | 7/1996 | Stephens et al. | 343/702 |
| 5,900,846 | A * | 5/1999 | Phelps et al. | 343/901 |
| 6,061,037 | A | 5/2000 | Brouwers | |

(Continued)

FOREIGN PATENT DOCUMENTS

| | | |
|---|---|---|
| DE | 847 302 C1 | 8/1952 |
| DE | 2154651 A1 | 5/1973 |

(Continued)

OTHER PUBLICATIONS

English translation of the International Preliminary Report on Patentability mailed May 19, 2011, in corresponding International Patent Application No. PCT/EP2009/004555, filed Jun. 24, 2009.

International Search Report mailed Aug. 20, 2009, issued in corresponding International Application No. PCT/EP2009/004555, filed Jun. 24, 2009, 3 pages.

Office Action mailed Oct. 23, 2013, issued in corresponding Chinese Patent Application No. 200980142007.4, filed Jun. 24, 2009, 16 pages.

*Primary Examiner* — Seung Lee

(74) *Attorney, Agent, or Firm* — Christensen O'Connor Johnson Kindness PLLC

(57) ABSTRACT

An antenna provides two antenna elements, which are connected to one another. The second antenna element can be connected to a radio device. The first antenna element and the second antenna element together form a first antenna part. The second antenna element alone forms a second antenna part. The first antenna element comprises at least in part at least one flexible metal strip. The second antenna element comprises at least in part a flexible corrugated tube.

10 Claims, 4 Drawing Sheets

(56) References Cited

U.S. PATENT DOCUMENTS

| | | | | |
|---|---|---|---|---|
| 6,075,488 | A * | 6/2000 | Hope | 343/702 |
| 6,201,500 | B1 * | 3/2001 | Fujikawa | 343/702 |
| 6,288,681 | B1 * | 9/2001 | Kim et al. | 343/702 |
| 7,132,998 | B2 * | 11/2006 | Ryou et al. | 343/895 |
| 7,167,131 | B2 * | 1/2007 | Martiskainen et al. | 343/702 |
| 8,018,387 | B2 * | 9/2011 | Kim et al. | 343/702 |
| 2006/0022883 | A1 * | 2/2006 | Vincent | 343/722 |
| 2008/0180334 | A1 | 7/2008 | Vincent | |
| 2008/0252535 | A1 | 10/2008 | Parsche | |
| 2011/0001685 | A1 * | 1/2011 | Yukimoto et al. | 343/905 |

FOREIGN PATENT DOCUMENTS

| | | | |
|---|---|---|---|
| EP | 0 896 385 | A1 | 2/1999 |
| EP | 1 411 588 | A1 | 4/2004 |
| JP | 2003-087030 | A | 3/2003 |

* cited by examiner

PORTABLE DUAL-BAND ANTENNA

The invention relates to a dual-band antenna, especially a portable, high-frequency, dual-band antenna.

Conventionally, different radio devices with different antennas are used for different frequency bands. However, this is disadvantageous because only a poor flexibility of use is provided.

EP 0 896 385 B1 discloses an antenna, which operates in two different frequency bands of 1.6 GHz and 2.4 GHz. It is made up from at least two antenna elements. The two antenna elements in this context are an extended radiating element and a linear radiating element, which is arranged in a spiral shape. The two radiating elements form a common antenna, which is used for both frequency bands. The antenna is structured in a rigid manner.

It is disadvantageous that the antenna presented provides poor loading stability because of its rigid embodiment and is therefore poorly suited for a robust use. Furthermore, the matching of the radiating elements for the two frequency bands leads to unfavourable antenna properties. Accordingly, its directional characteristic and also its quality are sub-optimal.

The invention is based upon the object of providing a robust, portable antenna, which operates with a high-quality over a very broad frequency range.

The object according to the invention is achieved by the features of the independent claim 1. Advantageous further developments form the subject matter of the dependent claims relating back to this claim.

An antenna comprises two antenna elements, which are connected to one another. The first antenna element comprises at least in part at least one flexible metal strip. The second antenna element comprises at least in part a flexible corrugated tube. Accordingly, a good robustness of the antenna is guaranteed. At the same time, portability is guaranteed. A good quality is also provided.

The second antenna element can be connected to a radio device. The first antenna element and the second antenna element together preferably form a first antenna part, while the second antenna element alone preferably forms a second antenna part.

The second antenna element preferably carries the first antenna element. This further improves portability.

By preference, the antenna elements provide a common longitudinal axis. Accordingly, good stability is achieved with low weight.

The antenna parts are each advantageously optimised for different frequency bands. Accordingly, the use of the antenna in a broad frequency range is possible. The first antenna part is preferably optimised for a frequency band from 30 MHz to 88 MHz. The second antenna part is preferably optimised for a frequency band from 200 MHz to 450 MHz. Accordingly, a use of the antenna in the two named frequency bands is possible.

The first antenna element is advantageously connected to the second antenna element by means of a coil which preferably connects the first antenna element electrically to the second antenna element for a low frequency range and preferably separates it electrically from the second antenna element for a high frequency range. An improvement in the quality of the antenna is achieved in this manner. Accordingly, two separate antennas for different frequency ranges are not required.

The antenna advantageously contains a matching network which is preferably connected to the second antenna element.

The second antenna element can preferably be connected to a radio device by means of the matching network. Accordingly, an optimal matching to the radio device is possible. In the case of a replacement of the antenna, the associated matching network is automatically also replaced. This increases reliability.

The matching network is advantageously arranged within the corrugated tube. This reduces the space requirement and therefore increases portability.

The matching network preferably matches the impedance of the antenna to the impedance of the radio device. The matching is preferably implemented dependent upon the frequency of the signals transmitted. Accordingly, an optimal interaction between the antenna and the radio device is guaranteed.

The first antenna element preferably provides a length from 600 mm to 1200 mm, preferably from 700 mm to 1000 mm, by particular preference of 800 mm. This allows favourable high-frequency properties. Moreover, it allows the antenna to be carried.

The second antenna element advantageously provides a length from 300 mm to 700 mm, preferably from 400 mm to 600 mm, by particular preference of 500 mm. This allows favourable high-frequency properties. Furthermore, it allows the antenna to be carried by a person.

The invention is described below on the basis of the drawings in which an advantageous exemplary embodiment of the invention is described by way of example. The drawings are as follows.

Figure 1:
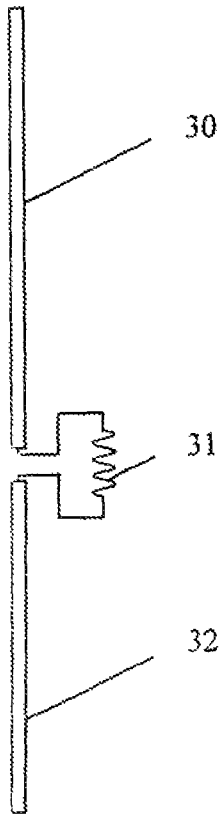
FIG. 1 shows a schematic view of an antenna according to the invention.
Figure 6:
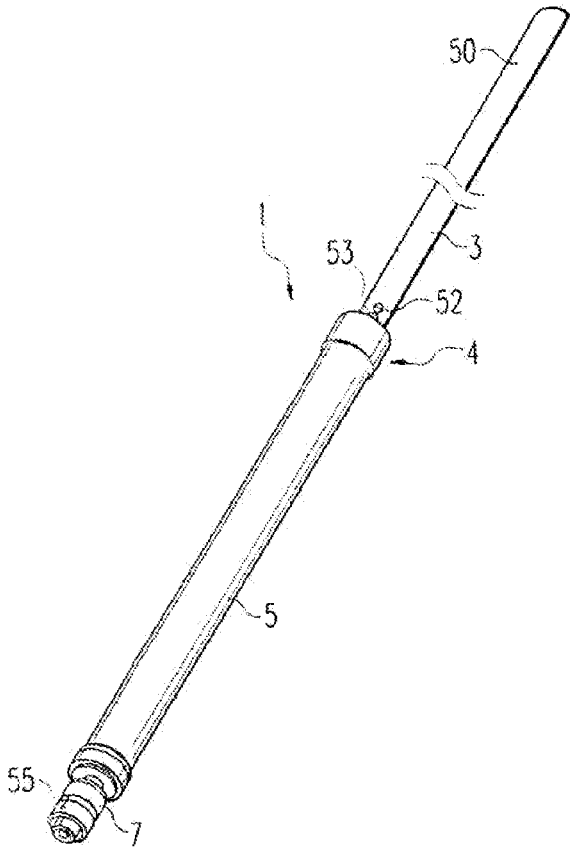
FIG. 6 shows a third exemplary embodiment of the antenna according to the invention in a perspective view.
Figure 7:
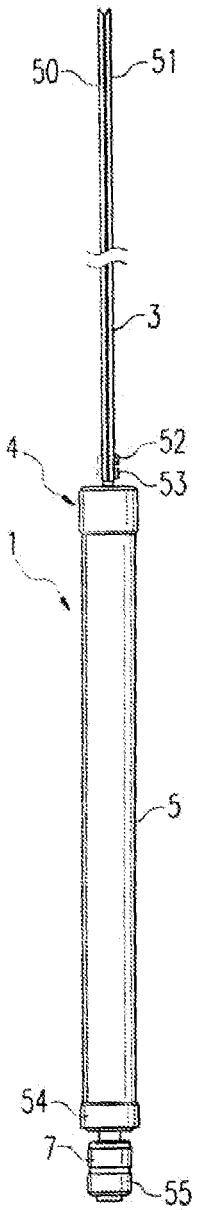
FIG. 7 shows a third exemplary embodiment of the antenna in a lateral view.
Figure 8:
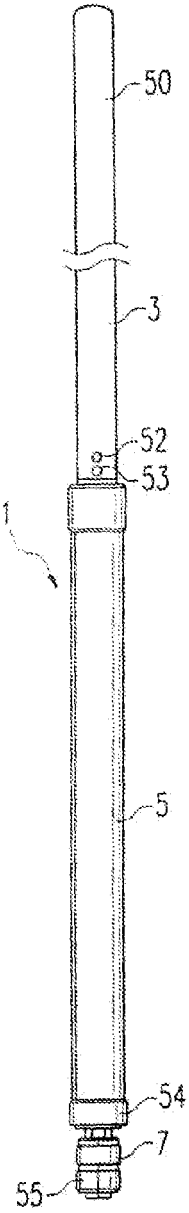
FIG. 8 shows a third exemplary embodiment of the antenna in a front view.

With reference to FIG. 1, the functional principle of the antenna according to the invention is first explained. With reference to FIGS. 2-8, the structure and functioning of different exemplary embodiments of the antenna according to the invention is shown. In this context, the general structure is presented with reference to FIG. 2 before individual details of the first and respectively a second exemplary embodiment are explained with reference to FIGS. 3-5. A third exemplary embodiment is shown in FIGS. 6-8. The presentation and description of identical elements in similar drawings has not been repeated in some cases.

FIG. 1 shows a schematic presentation of an antenna according to the invention. A first antenna element 30 provides a large extension along its longitudinal axis. It is connected via a coil 31 to a second antenna element 32. The second antenna element 32 also provides a long extension along its longitudinal axis. The longitudinal axes of the two antenna elements 30, 32 are largely identical. The second antenna element 32 in this context can be connected at its lower end to a radio device.

On the one hand, the second antenna element 32 forms an independent antenna part. This is achieved in that the coil 31 strongly attenuates the transmission of high frequencies between the two antenna elements 30, 32. Accordingly, signals of a high-frequency received by the first antenna element 30 cannot be transmitted to the radio device. However, the signals of high-frequency received from the second antenna element 32 can be received by the radio device.

On the other hand, the first antenna element 30 and the second antenna element 32 jointly form a further antenna part. This antenna part receives only signals of low frequencies. These signals are attenuated significantly less strongly by the coil 31. These signals can therefore also be received by the radio device.

Figure 2:
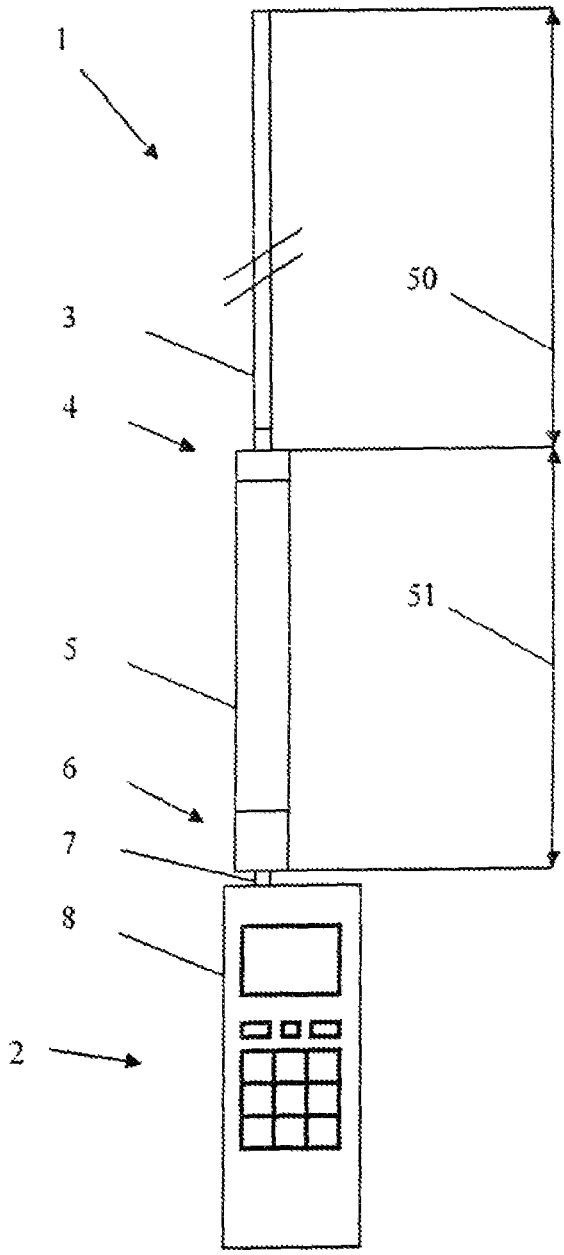
FIG. 2 shows a first exemplary embodiment of the antenna according to the invention.

FIG. 2 shows a first exemplary embodiment of the antenna 1 according to the invention. The antenna 1 comprises a first antenna element 3, a connecting element 4, a second antenna element 5 and a matching network 6. The first antenna element 3 comprises, for example, a flexible metal strip. Alternative embodiments are also possible. In particular, several metal strips can be layered one over the other and held together, for example, by a synthetic-material sleeve. The length of the first antenna element 3 is illustrated in the drawings in a shortened manner. Through the use of a flexible metal strip, a good robustness is achieved. Accordingly, the antenna 1 is resistant to damage from buckling. Furthermore, a metal strip of this kind can be folded or rolled up for transport. The first antenna element 3 in this exemplary embodiment has a length 50 of 800 mm. However, a length from 600 mm to 1200 mm would be equally possible.

The first antenna element 3 is connected by means of the connecting element 4 to the second antenna element 5. The second antenna element here provides a length 51 of 500 mm. This includes the length of the matching network 6 and of a part of the connecting element 4. A length from 300 mm to 700 mm could, however, also be used. The second antenna element 5 in this exemplary embodiment comprises a flexible corrugated tube. Alternative embodiments are also conceivable. In particular, tightly wound spiral springs could be used. A solid tube or a solid tube in combination with a gooseneck (gooseneck) can also be used as the corrugated tube.

The corrugated tube will be described in greater detail with reference to FIG. 4.

The connecting element 4 in this context contains the coil 31 described with reference to FIG. 1. The second antenna element 5 is connected by means of the matching network 6 to the connection 7 of the radio device 2 with the radio-device body 8. In this context, the radio device 2 is not a part of the antenna 1 according to the invention.

The antenna elements 3, 5 are enclosed by a protective sleeve made of synthetic material for protection against damage and corrosion. This sleeve is at least as flexible as the respective antenna element. The protective sleeve in this context can be designed to be removable.

Figure 3:
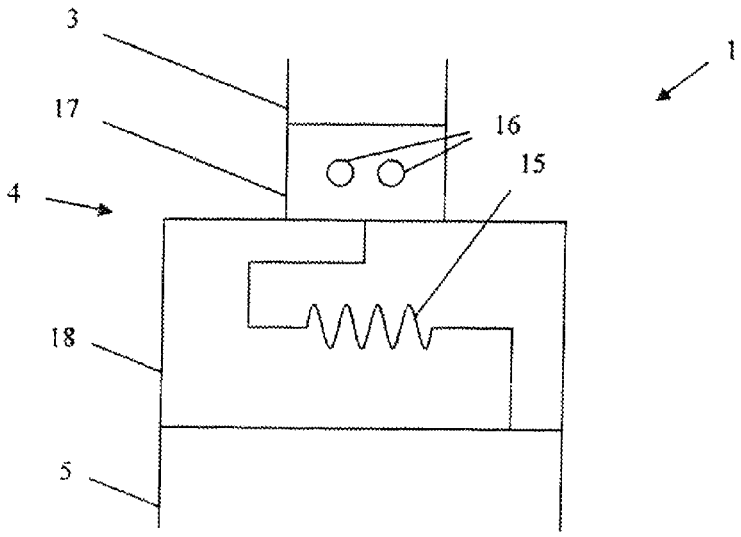
FIG. 3 shows a detail of the first exemplary embodiment of the antenna according to the invention.

FIG. 3 shows a first detail of the first exemplary embodiment of the antenna according to the invention. The connecting element 4 between the antenna elements 3, 5 will be explained with reference to this detail. It comprises a first holder 17, which is rigidly connected by the fastening means 16 to the first antenna element 3, and a second holder 18, which is rigidly connected to the second antenna element 5.

The second holder 18 in this context contains the coil 15, which corresponds to the coil 31 from FIG. 1. The one end of the coil 15 in this context is connected to the lower end of the first antenna element 3. The other end of the coil 15 is connected to the upper end of the second antenna element 5.

Figure 4:
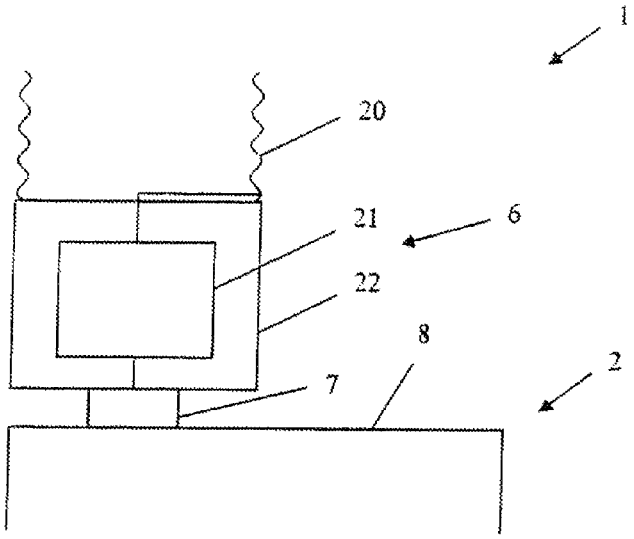
FIG. 4 shows a further detail of the first exemplary embodiment of the antenna according to the invention.

FIG. 4 shows a second detail of the first exemplary embodiment of the antenna according to the invention. With reference to this detail, the matching network 6 between the second antenna element 5 and the radio device 2 will be explained. Accordingly, the matching network 6 always comprises a housing 22 and a matching circuit 21. The housing 22 here connects the radio device 2 to a second antenna element 20. The matching circuit 21 is connected via the connection 7 of the radio device 2 to the radio-device body 8. Furthermore, the matching circuit 21 is connected to the second antenna element 20. The matching circuit 21 in this context implements an impedance matching. The impedance of the antenna 1 is matched to the impedance of the connection 7 of the radio device 2.

In this exemplary embodiment, the second antenna element 20 is a corrugated tube. A corrugated tube is characterised by a limited flexibility with good stability. The second antenna element 20 can accordingly be bent, for example, to a bending angle of 45°. Because of its elastic properties, it returns of its own accord to its starting position.

Figure 5:
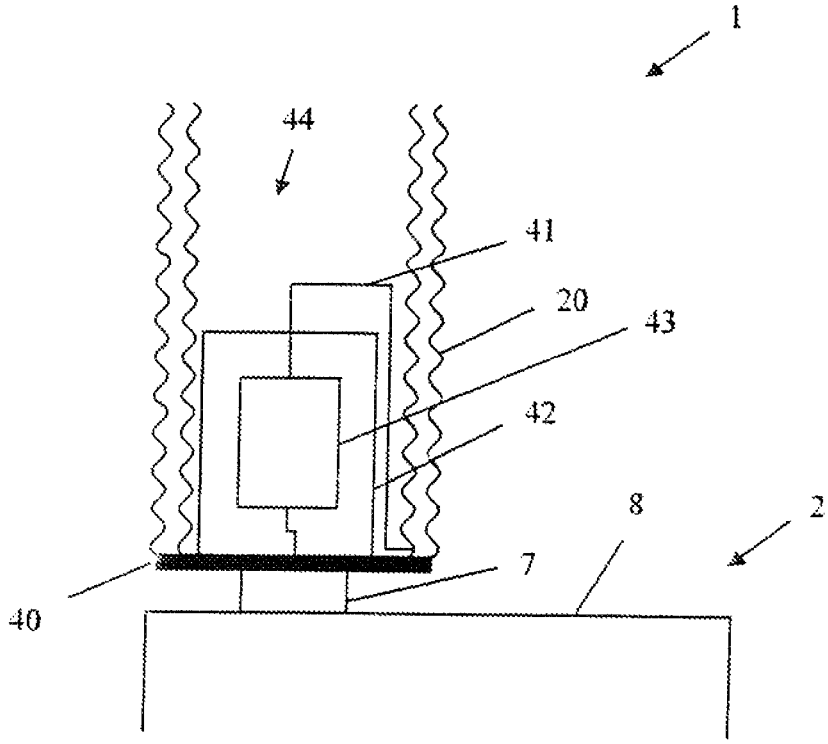
FIG. 5 shows a detail of a second exemplary embodiment of the antenna according to the invention in the region of the plug connection.

FIG. 5 presents a detail of a second exemplary embodiment of the antenna according to the invention. Here, a lateral sectional view through the corrugated tube 20 is shown in an alternative exemplary embodiment. In this exemplary embodiment, the matching network 44 is arranged inside the corrugated tube 20. Accordingly, an additional housing of the matching network 44 is not required. The corrugated tube 20 is accordingly lengthened by the length of the matching network.

The corrugated tube 20 and the matching network 44 are attached to a baseplate 40. The baseplate is connected via the connection 7 of the radio device 2 to the radio-device body 8. The housing 42 of the matching network 44 is in direct contact here with the baseplate. However, it is mounted with a spacing distance from the corrugated tube 20 in order to avoid reducing the flexibility of the corrugated tube 20.

A matching circuit 43 within the matching network 44 is connected to the connection 7 and via the line 41 to the lower end of the corrugated tube 20. The function of the matching network 44 corresponds to the function of the matching network 6 from FIG. 4.

FIGS. 6 to 8 show a third exemplary embodiment of the antenna according to the invention. Corresponding elements are provided with the same reference numbers thereby avoiding the need for a repetitive description. FIG. 6 shows a perspective view, while FIG. 7 shows a lateral view and FIG. 8 shows a front view.

One peculiarity of the third exemplary embodiment is that the first antenna element 3 are [?] made up of several flexible metal strips 50, 51, which are held together or pressed together in the exemplary embodiment by two screw connections 52 and 53. The connecting element 4, like the base element 54, comprises a cup-shaped body, into which the second antenna element 5 as a corrugated tube is inserted. Furthermore, the connection 7 is designed as a coaxial plug connection with a screw-connecting outer connector.

The invention is not restricted to the exemplary embodiment presented. As already mentioned, different lengths of the antenna elements can be used. The combination of more than two antenna elements by means of coils is possible. All of the features described above or illustrated in the drawings can be combined with one another advantageously as required within the framework of the invention.

The invention claimed is:

1. An antenna with first and second antenna elements:

wherein the first antenna element comprises at least in part at least one flexible metal strip;

wherein the second antenna element comprises at least in part a flexible corrugated tube;

wherein the second antenna element bears the first antenna element;

wherein the first antenna element and the second antenna element together form a first antenna part;

wherein the second antenna element alone forms a second antenna part, wherein the antenna parts are each optimized for different frequency bands, wherein:

the first antenna element is connected via a coil to the second antenna element;

the coil connects the first antenna element electrically to the second antenna element for a low-frequency range; and the coil separates the first antenna element electrically from the second antenna element for a high frequency range.

2. The antenna according to claim 1, wherein the antenna elements provide a common longitudinal axis.

3. The antenna according to claim 1, wherein the first antenna part is optimized for a frequency band from 30 MHz to 88 MHz and the second antenna part is optimized for a frequency band from 200 MHz to 450 MHz.

4. The antenna according to claim 1, wherein the second antenna element can be connected to a radio device.

5. The antenna according to claim 4, wherein the antenna contains a matching network, the second antenna element is connected to the matching network, and the second antenna element can be connected via the matching network to a radio device.

6. The antenna according to claim 5, wherein the matching network is arranged within the corrugated tube.

7. The antenna according to claim 5, wherein the matching network matches the impedance of the antenna to the impedance of the radio device, and that the matching is implemented dependent upon the frequency of transmitted signals.

8. The antenna according to claim 1, wherein the first antenna element provides a length from 600 mm to 1200 mm.

9. The antenna according to claim 1, wherein the second antenna element provides a length from 300 mm to 700 mm.

10. The antenna according to claim 1, wherein the coil is configured to attenuate the transmission of high frequencies between the first and second antenna elements.

* * * * *